US005952986A

United States Patent [19]

Nguyen et al.

[11] Patent Number: 5,952,986

[45] **Date of Patent: *Sep. 14, 1999**

[54] DRIVING METHOD OF AN AC-TYPE PDP AND THE DISPLAY DEVICE

[75] Inventors: Thanh Nhan Nguyen; Akira Otsuka, both of Akashi, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,485

[22] Filed: Mar. 7, 1997

[30] Foreign Application Priority Data

Apr. 3, 1996 [JP] Japan ..... 8-081422

[51] Int. Cl.[6] ..... G09G 3/28

[52] U.S. Cl. ..... 345/68; 345/60; 345/209

[58] Field of Search ..... 345/60, 62, 68, 345/208, 209

[56] References Cited

U.S. PATENT DOCUMENTS

| | | | |
|---|---|---|---|
| 5,075,597 | 12/1991 | Salavin et al. | 345/60 |
| 5,436,634 | 7/1995 | Kanazawa | 345/60 |
| 5,446,344 | 8/1995 | Kanawaza | 315/169.4 |
| 5,461,395 | 10/1995 | Stein | 345/60 |
| 5,523,771 | 6/1996 | Kim | 345/68 |
| 5,541,618 | 7/1996 | Shinoda | 345/68 |

FOREIGN PATENT DOCUMENTS

| | | |
|---|---|---|
| 0657861 | 6/1995 | European Pat. Off. . |
| 0680067 | 11/1995 | European Pat. Off. . |

*Primary Examiner*—Richard A. Hjerpe
*Assistant Examiner*—Ronald Laneau
*Attorney, Agent, or Firm*—Greer, Burns & Crain Ltd.

[57] ABSTRACT

In driving an AC type PDP of a matrix formation formed of lines and rows, the PDP includes: plural first and second sustain electrodes arranged on a first substrate, each extending along the line direction, the first & second sustain electrodes being in parallel and adjacent to each other; plural address electrodes arranged on a second substrate opposing the first substrate via a discharge space, each extending along the row direction; and a dielectric layer for covering the first and second sustain electrodes, wherein the method comprises: in causing a writing discharge between the first & second sustain electrodes, the step of: causing supplementally a discharge between the address electrode and the second sustain electrode, wherein the address electrode is positive with respect to the second sustain electrode; and concurrently causing said writing discharge between the first and second electrodes, wherein the first sustain electrode is positive with respect to the second sustain electrode. The second sustain electrode is preferably negative with respect to the reference voltage so that the supplied pulse voltages can be lowered.

8 Claims, 6 Drawing Sheets

DRIVING METHOD OF AN AC-TYPE PDP AND THE DISPLAY DEVICE

BACKGROUND OF THE INVENTION

1. Field of the Invention

The present invention relates to a driving method of an AC type plasma display panel, referred to hereinafter as a PDP, of a matrix formation having electrode pairs to determine surface discharge cells.

2. Description of the Related Arts

A surface discharge type PDP is suitable particularly for colored displays using fluorescent materials, among the AC driven PDPs where the wall charge is utilized for selective lighting. There is interest in such displays as a large screen display device for high-definition television.

FIG. 1 is a plan view schematically illustrating the electrode structure of a surface discharge type PDP 10. FIG. 2 schematically illustrates a decomposition perspective view, where are shown an internal structure of the surface discharge type PDP 10.

PDP 10 illustrated therein has plural electrode pairs 12 each of which consist of first and second sustain electrodes X & Y extending straight and mutually in parallel, and plural straight address electrodes A orthogonal to the first and second plural sustain electrodes X & Y. where each electrode pair 12 corresponds to a single line L, and each address electrode A corresponds to a single row, each of the display matrix.

That is, the electrode structure of a display cell C, i.e. a display element, of PDP 10 is of a three-electrode structure where electrode pair 12 intersects with address electrodes A.

Usually, first sustain electrodes X are commonly connected with each other for simplification of the driving circuit.

On the other hand, second sustain electrodes Y are independent as an individual electrode for each line L in order to enable line-sequential screen scanning.

As shown In FIG. 2, PDP 10 is composed of a first glass substrate 11 placed on the front side, first and second sustain electrodes X & Y thereon, a dielectric layer 17 thereon for the AC drive, a protection film 18 formed of magnesium oxide, referred to hereinafter as MgO, a second glass substrate 21 on the back side, address electrodes A thereon, separator walls 29 each straight in a plane on the second glass substrate 21 when looking down, and fluorescent layers 28 for the full color display, etc.

Discharge space 30 between the two glass substrates 11 and 21 is divided along the line direction, i.e. the direction along which the first and second sustain electrodes X & Y are extending, by separator walls 29 into each sub-pixel EU, whereby the gap size between two glass substrates 11 & 21 is also determined.

First and second sustain electrodes X & Y are arranged on the inner surface of first glass substrate 11. Each of sustain electrodes X & Y is composed of a wide transparent conductive film 41 and a metal film 42 thereon for securing its electrical conductivity.

Transparent conductive film 41 is patterned as a belt shape wider than metal film 42 so that the surface discharge may expand.

In order to reduce ion bombardment caused from the surface discharge, fluorescent layer 28 is located away from sustain electrodes X & Y, between each separator wall 29 on second glass substrate 21. Fluorescent layer 28 is locally excited by the ultraviolet rays generated in the surface discharge, so as to emit light.

Among the visible radiations emitted from the surface of fluorescent layer 28, i.e. the surface to face the discharge space, the light which can penetrate through glass substrate 11 becomes a display light.

Pixel, i.e. picture element, EG of the screen matrix consists of three sub-pixels EU which line up along the line direction, where the lighting colors of the three sub-pixels EU are mutually different as denoted with R, G and B, so that each displayed color of a single pixel is determined by the combination of the basic R, G, and B. Each subpixel is formed of the display cell C and an address cell which is not drawn in the figure, but is located at the intersection of address electrode A and second sustain electrode Y.

The pattern arrangement of separator walls 29 is called a stripe pattern, where the part which corresponds to each row in discharge space 30 extends in the row direction continuously to cross over all the lines. The emitting color of sub-pixels EU in each row is identical.

Second sustain electrode Y of the electrode pair 12 and address electrode A are used for selecting, i.e. addressing, a pixel EU to light or not to light. That is, a screen scanning is performed sequentially line by line by applying a scan pulse onto sequential ones of n sustain electrodes, where n indicates the quantity of the lines; and a predetermined electrically charged state is formed in the thus selected address cell of each row by an opposing discharge, i.e. an address discharge, generated between the second sustain electrode Y and an address electrode A selected in accordance with the contents of the display.

After the addressing operation is thus performed, upon an application of the sustain pulses of a predetermined peak value alternately onto first and second sustain electrodes X & Y, a surface discharge, i.e. sustain discharge, takes place in the display cell C in which wall charges of a predetermined amount existed at the end of the addressing operation.

FIGS. 3A and 3B schematically illustrate a prior art driving method for the reset period. FIG. 3A schematically illustrates waveforms of applied voltages to each electrode; and FIG. 3B schematically illustrates discharges in the display cell.

In the AC drive in which the wall charge is utilized, it is necessary to initialize the electrically charged states of dielectric layer 17 prior to the addressing operation, i.e. rewriting, of the screen in order to prevent an influence of the previous screen.

Therefore, a reset period is provided prior to the address period.

In the prior art driving method during reset period TR, the surface discharge, i.e. the writing discharge, was caused, as shown in FIG. 3B with solid arrows, between first and second sustain electrodes X & Y by the application of a write pulse Pw having a peak value of, for instance, 340V. The pulse Pw exceeds the surface discharge starting potential VfXY, for instance, 250–960V, onto first sustain electrode X as shown in FIG. 3A, while second sustain electrode Y is kept at zero voltage.

Moreover, in order to prevent a discharge between first sustain electrode X and address electrode A, a pulse Paw having, for instance, a peak value 110 V of the same polarity as writing pulse Pw was applied to address electrode A concurrently to the application of writing pulse Pw, where the voltage difference between first sustain electrode X and address electrode A is lower than the discharge firing voltage therebetween.

This is because, if a discharge having address electrode A as a cathode is caused between first sustain electrode X and address electrode A, as shown with an arrow drawn with a broken line in FIG. 3B, positive ions generated by the discharge collide with fluorescent layer 28, resulting in deterioration of the fluorescent material.

In this specification, the term "writing discharge" indicates a discharge compulsorily caused by an application of a driving voltage which exceeds the surface discharge firing voltage.

The wall charges are once accumulated on dielectric layer 17 by the writing discharge. However, in response to the fall of writing pulse Pw there is caused a so-called self-discharge of the wall charge whereby the wall charges on dielectric layer 17 almost disappear.

In another driving method, during reset period that voltages having mutually reversed polarities are applied concurrently to first sustain electrode X and second sustain electrode Y so that the voltage difference between first and second sustain electrodes X & Y becomes higher than surface discharge firing voltage VfXY. This method relaxes a restriction of the withstanding voltage rating of the driving circuit.

However, the driver circuit of second sustain electrodes Y, which are individual, becomes complex.

A problem in the prior art method was in that some of the wall charges were generated so excessively during the write discharge that the wall charges remained even when the self-discharge was generated thereafter, because the peak value of writing pulse Pw, i.e. a writing voltage, was set so high that the potential difference between first and second sustain electrodes X & Y would surely cause the write discharge regardless of the existence of the remaining wall charge. It is also a natural requirement that a lower writing voltage is preferable.

SUMMARY OF THE INVENTION

It is a general object of the invention to provide a method and a device to drive a PDP allowing a lower writing voltage so as to allow more margin for the driving voltage of the reset operation.

It is another object of the present invention to simplify the driving circuits to perform the reset operation, the addressing operation and the sustain operation.

In the method to drive an AC type plasma display panel of a matrix formation formed of lines and rows according to the present invention, where the plasma display panel includes: a plurality of first and second sustain electrodes arranged upon a first substrate, each extending along the line direction, the first and second sustain electrodes being in parallel and adjacent to each other; a plurality of address electrodes arranged upon a second substrate opposing the first substrate via a discharge space, each extending along the row direction; and a dielectric layer for covering the first and second sustain electrodes, wherein the method comprises, in causing a compulsory discharge between the first and second sustain electrodes X & Y, the steps of: causing a first discharge between the address electrode and the second sustain electrode, wherein the address electrode is applied with a first positive potential with respect to the second sustain electrode Y; and concurrently causing a second discharge between the first sustain electrode X and the second sustain electrode Y, wherein the first sustain electrode X is applied with a second positive potential with respect to the second sustain electrode. A priming effect of the first discharge lowers the firing voltage of the second discharge.

The above-mentioned features and advantages of the present invention, together with other objects and advantages, which will become apparent, will be more fully described hereinafter, with references being made to the accompanying drawings which form a part hereof, wherein like numerals refer to like parts throughout.

BRIEF DESCRIPTION OF THE DRAWINGS

FIGS. 2A and 2B schematically illustrate a decomposition perspective view showing an internal structure of a surface discharge type PDP, wherein FIG. 2B is an enlarged sectional view of the portion encircled by the broken line in FIG. 2A;

DESCRIPTION OF THE PREFERRED EMBODIMENT

Figure 4:
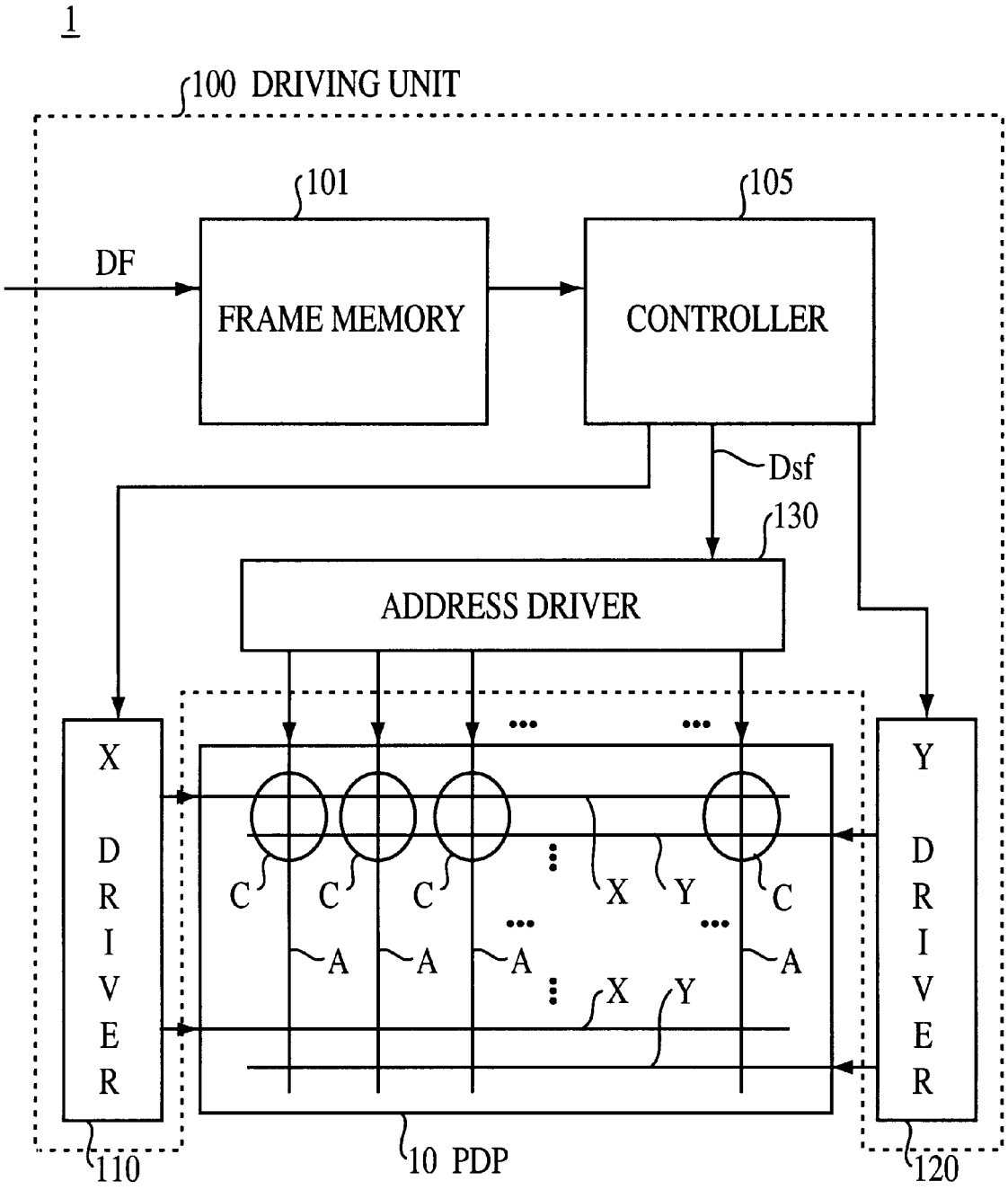
FIG. 4 schematically illustrates a block diagram of a plasma display device related to the present invention.

A practical preferred embodiment of the present invention is hereinafter described with reference to the drawings. FIG. 4 schematically illustrates a block diagram of a plasma display device 1 in which the present invention is embodied.

Plasma display device 1 consists of a PDP 10 of an AC type full color display panel and a driver unit 100 to selectively lighten the display cells C which compose the display screen, and may be used as a monitor of a computer system and a wall-hung type television receiver, etc. The display cell will be explained later in detail.

In assembling plasma display device 1, driver unit 100 is placed on the back side of PDP 10 so as to be electrically connected with PDP 10 via a printed circuit board, which is not shown in the figures.

In the classification based on the discharge types, PDP10 is of a surface discharge type, where the paired first and second sustain electrodes X & Y for causing the main discharge are arranged in parallel.

Display cell C is formed at each intersection of the electrode matrix of address electrodes A and the pair of first and second sustain electrodes X & Y.

Figure 1:
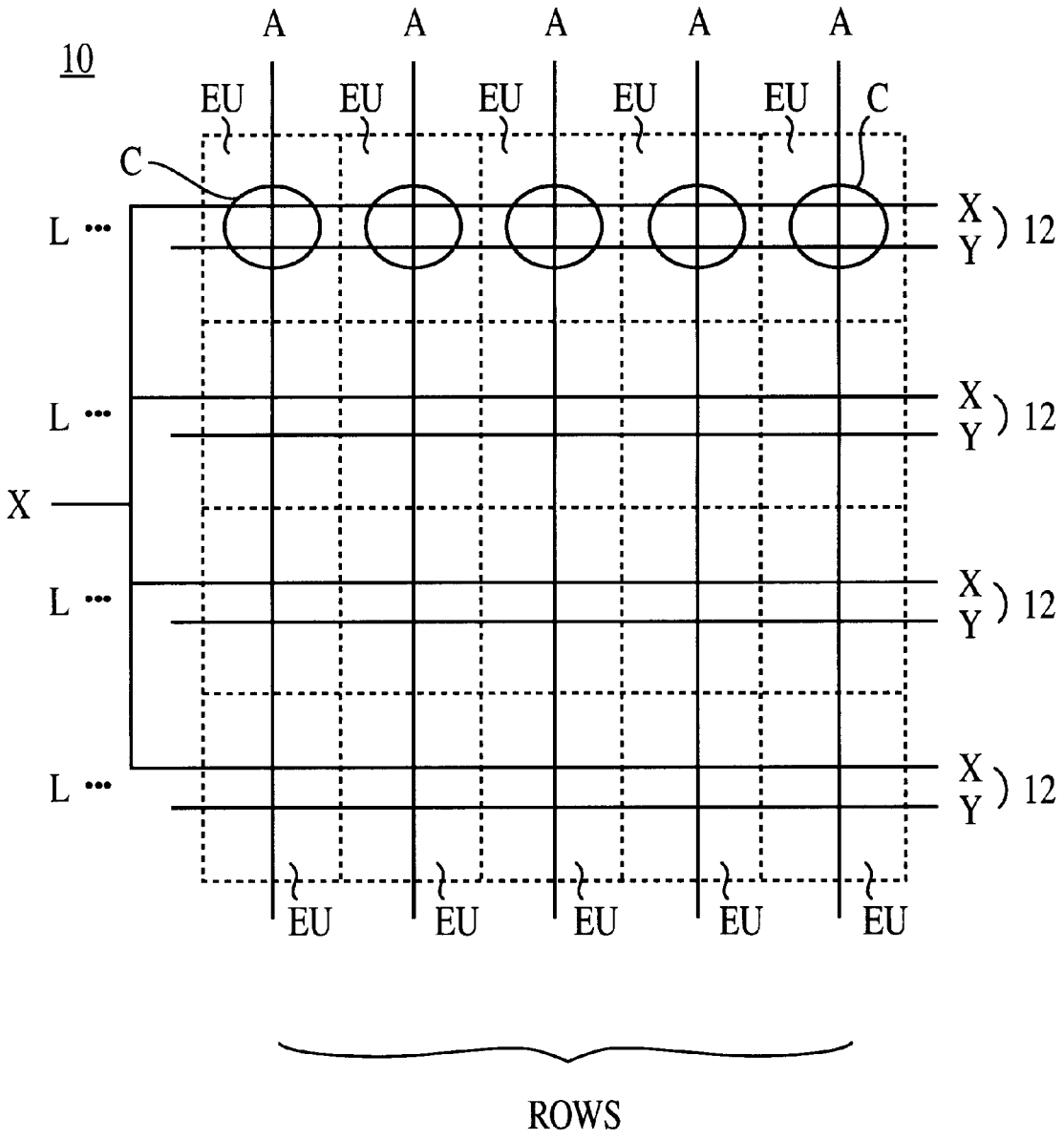
FIG. 1 schematically illustrates a plan view of an electrode structure of a surface discharge type PDP.
Figure 2A:
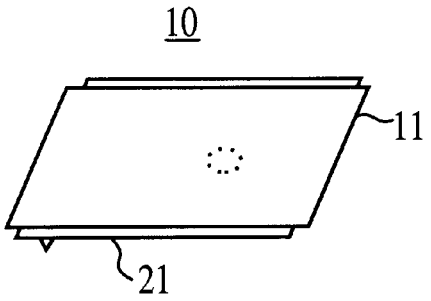
Figure 2B:
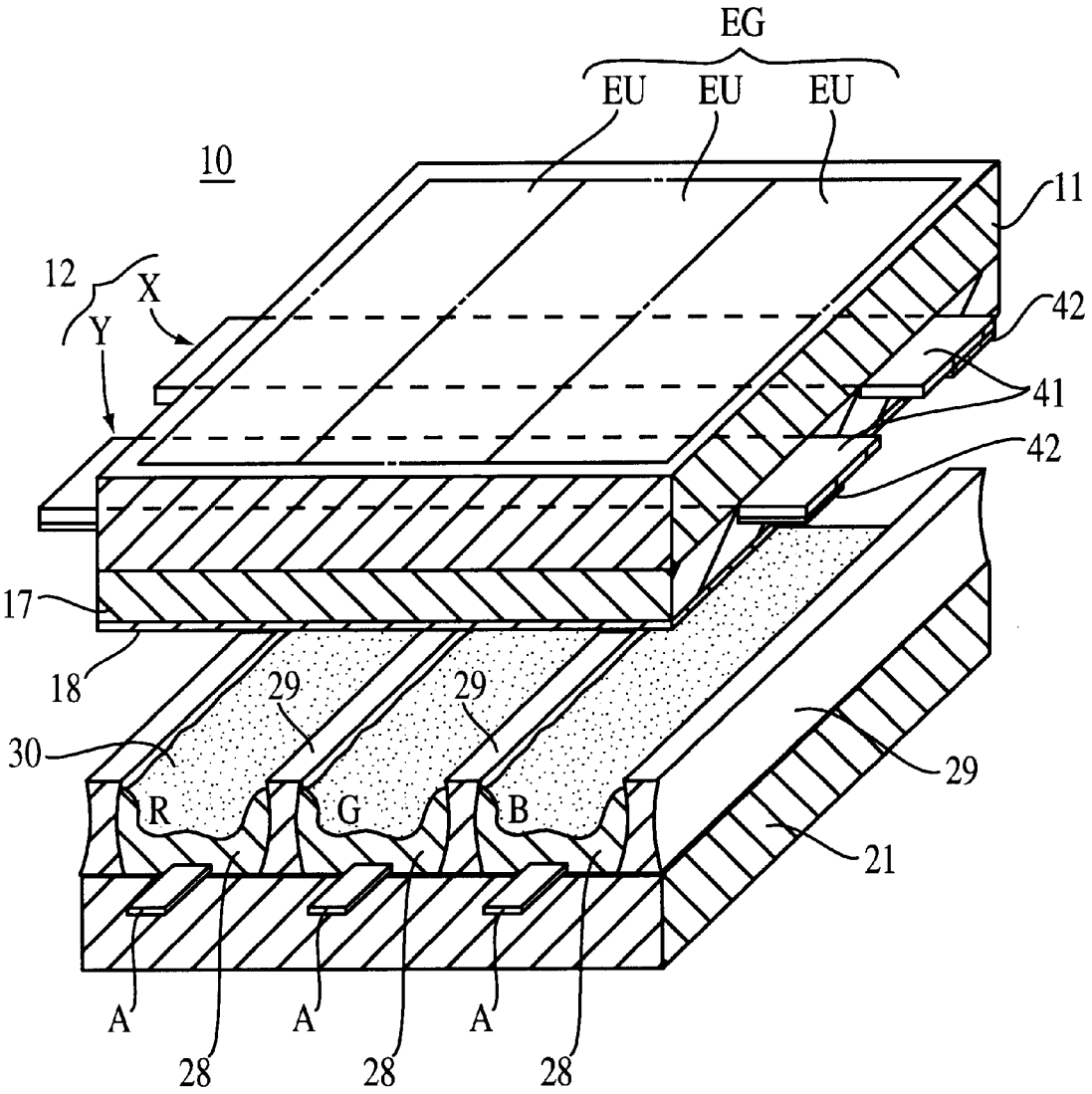
Figure 3A:
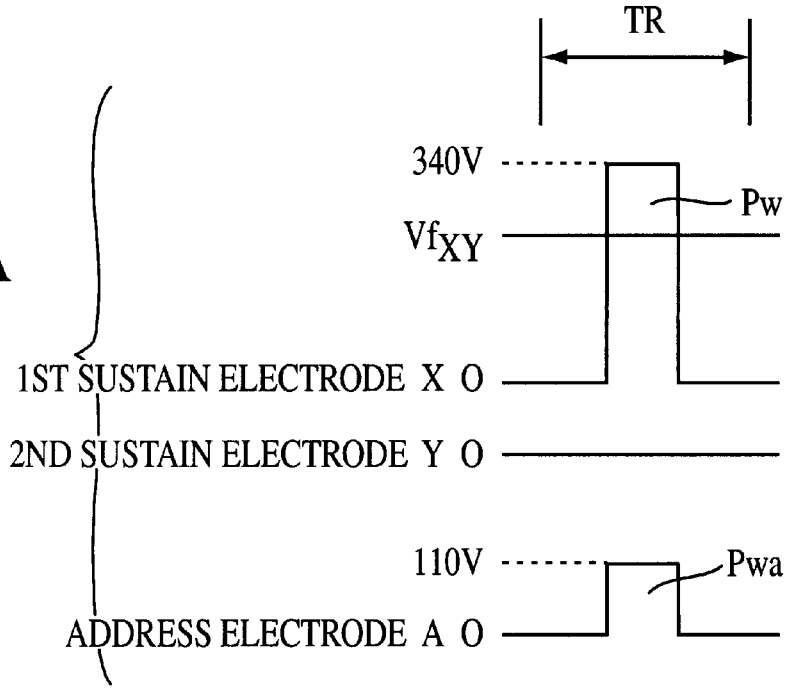
FIG. 3A schematically illustrates prior art waveforms of the voltages applied during a reset period.
Figure 3B:
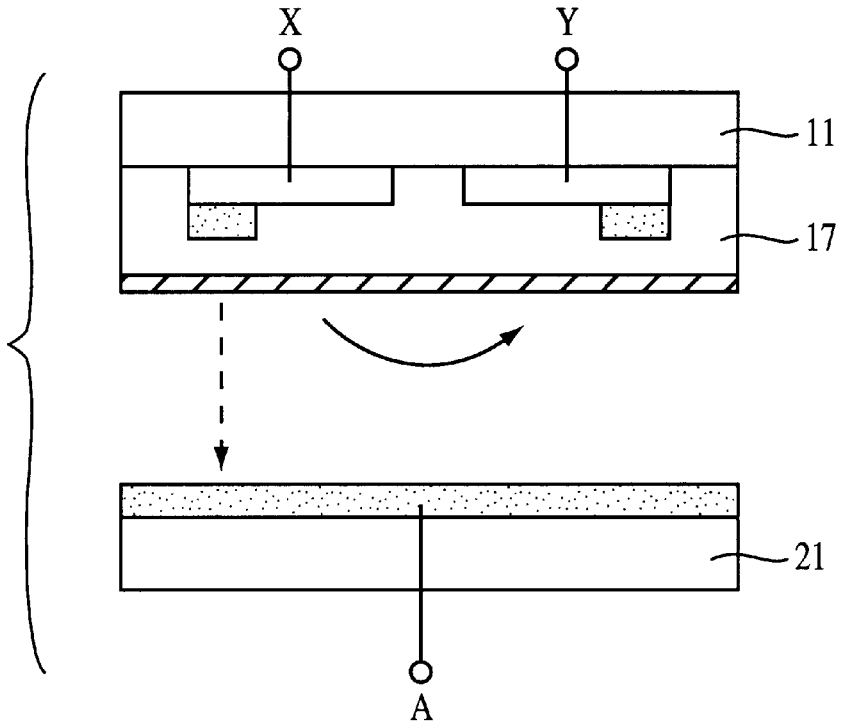
FIG. 3B PRIOR ART
FIG. 3B schematically explains the prior art discharges generated during a reset period.

The internal structure of PDP 10 is that explained in the above "BACKGROUND OF THE INVENTION" with reference to FIG. 2.

Driving unit 100 includes: a frame memory 101 for temporarily storing an input video data DF, a controller 105 for receiving an output data of frame memory 101 and for controlling the electrode drivers, an X driver 110 for applying driving voltages to first sustain electrodes X according to an output of controller 105, a Y driver 120 for applying driving voltages to second sustain electrodes Y according to an output of controller 105, and an address driver 130 for applying driving voltages to address electrodes A according to an output of controller 105.

Video data DF is a group of n-ary data for indicating brightness of each of three colors R, G and B of each pixel of the screen.

Subfield data Dsf forwarded from controller 105 to address driver 130 is a group of binary data to determine whether each of the display cells C is to light or not in each subfield divided from each frame.

Hereinafter is explained a driving method of PDP 10. At first, general principle of the present invention is hereinafter described.

Opposing discharges between the substrates facing each other can be generated more easily than the surface discharge along the substrate surface. That is, the firing voltage VfAY between address electrode A and the opposing second sustain electrodes Y is lower than the surface discharge firing voltage VfXY.

This is because discharge space 30 is activated by the opposing discharge, resulting in a decrease in surface discharge starting voltage VfXY. Therefore, the writing voltage can be lowered by additionally causing the opposing discharge.

In an opposing discharge in which address electrode A is used as the anode, the fluorescent material being coated on the side of address electrodes A is protected from the deterioration caused from the positive ion bombardment thereonto.

Moreover, in the opposing discharge in which address electrode A is used as an anode is likely to be caused because in order to protect the dielectric layer there is usually coated MgO, which is of a high secondary emission coefficient, i.e. a high gamma material, on the surface of first and second sustain electrodes X & Y.

Figure 5:
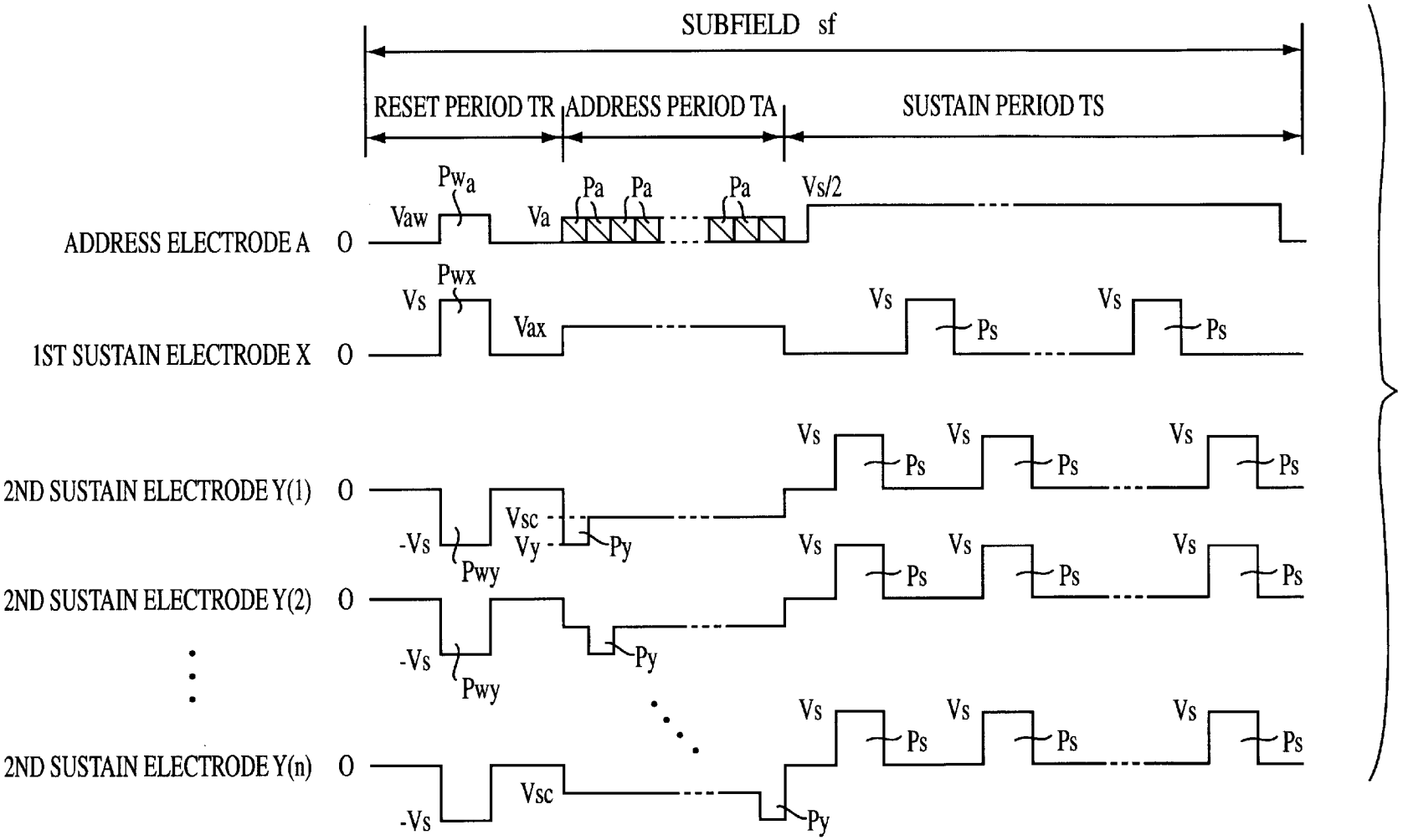
FIG. 5 schematically illustrates waveforms of the applied voltages of the present invention.

FIGS. 5 schematically illustrates waveforms of the voltages applied to each electrode.

In a display using PDP 10, a single field, i.e. a single screen, corresponds to a single frame, for instance.

However, when the screen is scanned to reproduce an interlace format such as a television, two fields are used to display a single screen.

In order to display the brightness gradation, the field is divided into, for example, six to eight subfields sf. Each subfield sf consists of a reset period TR, address period TA and sustain period TS. Each subfield sf is respectively weighted for predetermined brightness, i.e. a gradation level, by setting a quantity of the lighting in the sustain period TS, as disclosed in U.S. Pat. No. 5,541,618.

Each subfield sf is a display period for the predetermined gradation level.

Reset period TR is a period during which all the charges on the display screen are erased in order to prevent the influence of the previous lighting state, which may also be called an entire-surface erasion. During this reset period TR the driving method specific to the present invention is performed, which will be described later in detail.

Address period TA is a period during which a line-sequential addressing operation is performed. First sustain electrodes X are applied with a positive potential Vax, for instance, 55V, with respect to the earth potential, and all the second sustain electrodes Y are applied with a negative potential Vsc with respect to the earth potential, for instance −70V.

Under such a condition, each line is sequentially selected one by one beginning from a top line by applying thereto a scanning pulse Py of the negative polarity, for instance, −170V. That is, the sustain electrode Y of the selected line is temporarily biased to negative potential Vy, −170V.

Concurrent to the selection of the line, an address pulse Pa of positive polarity having a peak value Va, for instance, 60V, is applied to a specific address electrode A that is associated with a display cell to be lit. At the display cell on the selected line and to which address pulse Pa is applied, an address discharge takes place between second sustain electrode Y and address electrode A.

No discharge takes place between first sustain electrode X and address electrode A of the cell because the thus selected first sustain electrode X is biased at a potential Vax having the polarity of the address pulse Pa so as to make the potential difference between the first sustain electrode X and address electrode A lower than the discharge firing voltage therebetween.

Moreover, pulse voltage Vax of first sustain electrode X is set such that the voltage difference between first and second sustain electrodes X & Y is lower than the surface discharge firing voltage VfXY in order to prevent the non-selected cells on the line from being erroneously charged.

Surface discharge firing voltage VfXY is higher than firing voltage VfAY between second sustain electrode Y and address electrode A. Voltages Vax, Vy and Va satisfy the following relations.

$$|Vax-Vy|<|VfXY|=\text{typically } 250\text{–}260 \text{ V}$$

$$|Va-Vy|\geqq|VfAY|=\text{typically } 150\text{–}160 \text{ V}$$

Sustain period TS is a period during which the number of times for a cell to light set in the addressing period is reproduced so as to achieve the thus set brightness gradation level.

On the other hand, in order to prevent an opposing discharge, i.e. a discharge across the discharge space, all address electrodes A are applied with a positive polarity potential of, for instance, Vs/2, and at the beginning a sustain pulse Ps of positive polarity having a peak value Vs is applied to all second sustain electrodes Y.

Thereafter, a sustain pulse Ps is applied alternately onto first sustain electrodes X and second sustain electrodes Y. Upon each application of sustain pulse Ps, the surface discharges take place in the cells that have accumulated the wall charge during address period TA.

Figure 6A:
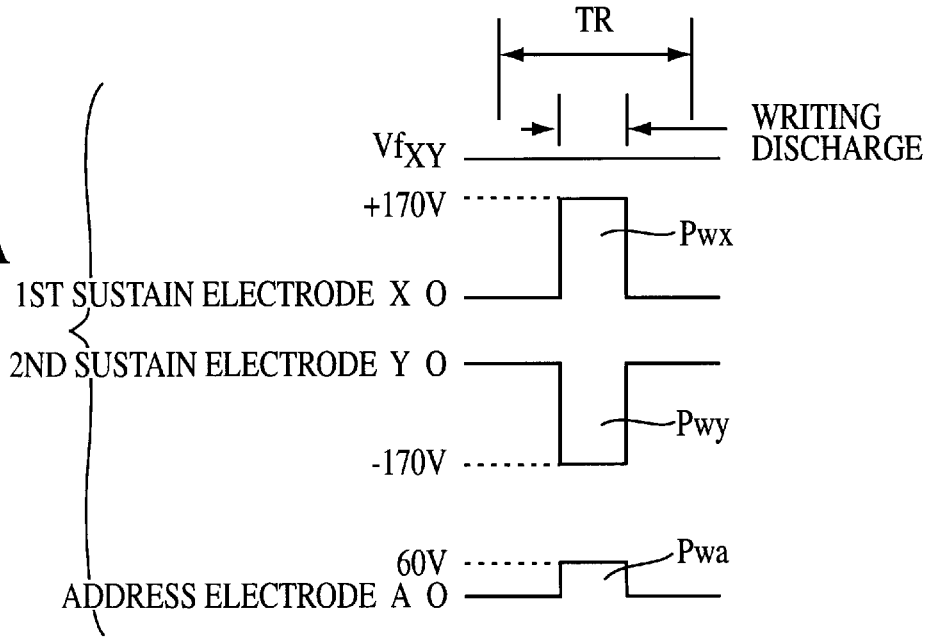
FIG. 6A schematically illustrates waveforms of the voltages applied during a reset period according to the present invention.
Figure 6B:
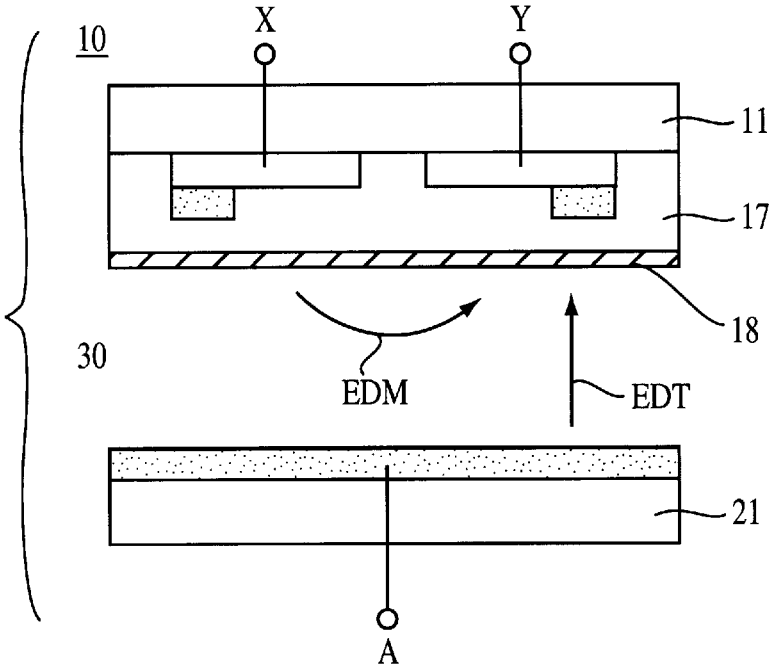
FIG. 6B schematically explains the discharges generated during a reset period according to the present invention.

FIGS. 6A and 6B schematically illustrate the reset operation in which the driving method of the present invention is embodied. FIG. 6A schematically illustrates waveforms of the voltages applied to each electrode. FIG. 6B schematically illustrates the discharges in the cell.

During the reset period TR as shown in FIG. 6A, a writing pulse Pwx or positive polarity, for instance, of 60–170V peak value, which is lower than a surface discharge firing voltage VfXY, is applied to first sustain electrodes X; and at the same time a write pulse Pwy of negative polarity having a peak value, for instance −170V, is applied to second sustain electrodes Y.

Additionally, a writing pulse Pwa of positive polarity having a peak value, 60V for instance, is applied to address electrodes A. As a result, a discharge EDT, which is an opposing discharge called a "trigger discharge", takes place at first between address electrode A and second sustain electrodes Y, where address electrodes A act as anodes.

At this time, secondary emissions are emitted from MgO film 18 coated on the surface of dielectric layer 17 so as to effectively activate the discharge space 30 because the secondary electrons generated from the MgO film coated via the dielectric layer on the sustain electrodes effectively function as a priming agent.

A priming effect of discharge space 30 thus activated by the trigger discharge EDT lowers the surface discharge firing potential VfXY so as to cause a surface discharge EDM which is the main discharge between first and second sustain electrodes X and Y.

In this case, the series of the trigger discharge EDT and the surface discharge EDM is the writing discharge. Owing to the lowered writing voltages applied between first and second sustain electrodes X and Y, a proper, i.e. non excessive, amount of wall charges are generated upon dielectric layer 17 by this writing discharge; accordingly, the wall charges properly disappear by a self-discharge caused by the fall of write pulses Pwx and Pwy.

Thus, there is allowed a margin, compared with the prior art method, in setting the writing voltage owing to the decrease in the surface discharge firing potential VfXY resulted from the trigger discharge EDT.

In the case where second sustain electrode Y is kept at the earth potential, address electrode A is the anode.

Though not illustrated in the figure, as a second preferred embodiment, the second sustain electrode may be kept at the reference voltage, i.e. 0 V, where address electrode A is applied with +210 V while first sustain electrode X is applied with +210 V, for example, which is far below 340 V of the prior art voltage applied thereto.

The circuit structure of Y driver 120 can be simplified by employing a voltage common to the pulse voltage of writing pulse Pwy and a scan pulse voltage vy to be applied during the addressing period TA to each second sustain electrodes Moreover, the circuit structure of A driver 130 can be simplified by employing a pulse voltage which is common to writing pulse Pwa and the address pulse P6.

Furthermore, the circuit structure of X driver 110 can be simplified by employing a peak voltage common to writing pulse Pwx and sustain pulse Ps.

The writing voltage can be decreased; accordingly more margin in the driving voltage can be allowed according to the present invention. In other words, there can be achieved a display which is not affected by the fluctuation of the driving voltages.

When pulse voltages, i.e. the peak values of the applied pulses, are made common for the reset operation, the addressing operation and the sustain operation, the number of power sources necessary for the drive can be decreased, resulting in simplification or the driving circuits.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, it is not detailed to limit the invention and accordingly, all suitable modifications are equivalents may be resorted to, falling within the scope of the invention.

What is claimed is:

1. A method to drive an AC type plasma display panel of a matrix display formation formed of lines and rows, the plasma display panel including a plurality of first and second sustain electrodes arranged upon a first substrate, each extending along the line direction, the first and second sustain electrodes being in parallel and adjacent to each other; a plurality of address electrodes arranged upon a second substrate opposing the first substrate via a discharge space, each extending along the row direction; and a dielectric layer for covering the first and second sustain electrodes, wherein the method comprises, during a writing discharge between said first and second sustain electrodes for resetting a charge state of a single picture, the steps of:

biasing said address electrode and said second sustain electrode so as to cause a first discharge having said address electrode as an anode between said address electrode and said second sustain electrodes; and concurrently biasing said first sustain electrode to a potential positive with resect to said second sustain electrode to create a second discharge therebetween, said second discharge being triggered by said first discharge.

2. A method to drive an AC type plasma display panel as recited in claim 1, wherein said second sustain electrode is applied with a potential negative with respect to a reference level.

3. A method to drive an AC type plasma display panel as recited in claim 1, wherein said second sustain electrode is applied with a zero voltage with respect to a reference level.

4. A method to drive an AC type plasma display panel as recited in claim 1, wherein, after said writing discharge is carried out as a reset operation of the single picture according to the method recited in claim 1, the method further comprises a step of:

causing an addressing discharge between said address electrode and said second sustain electrode for an addressing operation, wherein potentials of said address electrode and said second sustain electrode are substantially identical to said potentials respectively applied to said address electrode and said second sustain electrode during said writing discharge.

5. A method to drive an AC type plasma display panel as recited in claim 4, wherein, after said reset operation and said addressing operation by the method recited in claim 4, the method further comprises a step of:

causing a sustain discharge between said first sustain electrode and said second sustain electrode as a sustaining operation, wherein potential of said first sustain electrode is substantially identical to said potential applied to said first sustain electrode at said resetting operation.

6. A method to drive an AC type plasma display panel as recited in claim 1, wherein said first discharge triggers said second discharge via a priming effect which lowers the surface discharge firing potential between said first sustain electrode and said second sustain electrode.

7. A plasma display device comprising:

an AC type plasma display panel of a matrix display formation provided with first and second sustain electrodes arranged upon a first substrate, each extending along a line direction, the first and second sustain electrodes being in parallel and adjacent to each other; address electrodes arranged upon a second substrate opposing the first substrate via a discharge space, each extending along a row direction orthogonal to the line direction; and a dielectric layer for covering the first and second sustain electrodes, and a driving circuit for applying voltages to said second sustain electrode and said address electrode so as to cause supplementally a first discharge between said address electrode and said second sustain electrode, wherein said voltage applied to said address electrode is positive with respect to said second sustain electrode voltage, and for concurrently applying a voltage positive with respect to the second sustain electrode to said first sustain electrode so as to cause a writing discharge between said first sustain electrode and said second sustain electrode, said writing discharge being triggered by said first discharge and said writing discharge resetting a single picture element of the display panel.

8. A plasma display device as recited in claim 7 wherein said first discharge triggers said writing discharge via a priming effect which lowers the surface discharge firing potential between said first sustain electrode and said second sustain electrode.

* * * * *

UNITED STATES PATENT AND TRADEMARK OFFICE

CERTIFICATE OF CORRECTION

PATENT NO. : 5,952,986

DATED : September 14. 1999

INVENTOR(S) : Nhan et al.

It is certified that error appears in the above-identified patent and that said Letters Patent is hereby corrected as shown below:

On the title page:

Under "[75] Inventors" please delete "Thanh Nhan Nguyen" and insert --Nguyen Thanh Nhan"

Under "United States Patent [19]" please delete "Nguyen et al." and insert --Nahn et al.-- therefor Column 2, line 57, delete "960V" and insert --260V-- therefor Column 5, line 33, delete "FIGS." and insert --FIG.-- therefor

UNITED STATES PATENT AND TRADEMARK OFFICE

CERTIFICATE OF CORRECTION

PATENT NO. : 5,952,986

DATED : September 14, 1999

INVENTOR(S) : Nhan et al

It is certified that error appears in the above-identified patent and that said Letters Patent is hereby corrected as shown below:

Column 7, line 21, delete "electrodes" and insert --electrode Y-- therefor

Column 7, line 64, delete "resect" and insert

--respect-- therefor;

Column 8, line 59, after "first discharge"

insert --,-- (comma)

Signed and Sealed this

Seventeenth Day of October, 2000

*Attest:*

Q. TODD DICKINSON

*Attesting Officer*

*Director of Patents and Trademarks*